US009676461B2

(12) United States Patent
Nakayama et al.

(10) Patent No.: US 9,676,461 B2
(45) Date of Patent: Jun. 13, 2017

(54) FUEL SUPPLY DEVICE AND OUTBOARD MOTOR

(71) Applicant: YAMAHA HATSUDOKI KABUSHIKI KAISHA, Iwata-shi, Shizuoka (JP)

(72) Inventors: Koichi Nakayama, Shizuoka (JP); Yukinori Nose, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 705 days.

(21) Appl. No.: 13/859,766

(22) Filed: Apr. 10, 2013

(65) Prior Publication Data

US 2014/0026862 A1 Jan. 30, 2014

(30) Foreign Application Priority Data

Jul. 24, 2012 (JP) ..... 2012-163287

(51) Int. Cl.

| | |
|---|---|
| ***B63H 20/00*** | (2006.01) |
| ***F02M 37/14*** | (2006.01) |
| ***F02M 39/00*** | (2006.01) |
| ***B63H 20/24*** | (2006.01) |
| ***B63H 21/38*** | (2006.01) |

(52) U.S. Cl.

CPC ..... *B63H 20/001* (2013.01); *B63H 20/24* (2013.01); *B63H 21/38* (2013.01); *F02M 37/14* (2013.01); *F02M 39/00* (2013.01); *F02M 39/005* (2013.01)

(58) Field of Classification Search

CPC ..... B63H 20/001; B63H 20/24; F02M 39/00; F02M 39/005

USPC ..... 123/495, 349, 406.44; 440/88 F, 84, 440/89 B; 137/202

See application file for complete search history.

(56) References Cited

U.S. PATENT DOCUMENTS

| | | | | |
|---|---|---|---|---|
| 6,244,915 | B1 * | 6/2001 | Ozawa | F02M 31/20 440/88 F |
| 6,279,543 | B1 * | 8/2001 | Niethammer | F02M 45/00 123/506 |
| 6,318,344 | B1 * | 11/2001 | Lucier | F02D 33/006 123/497 |
| 6,422,207 | B1 * | 7/2002 | Kolb | F02M 31/20 123/457 |
| 6,431,199 | B1 * | 8/2002 | Kolb | F02M 37/20 123/516 |

(Continued)

FOREIGN PATENT DOCUMENTS

JP 2011-190704 A 9/2011

*Primary Examiner* — Jacob Amick

(74) *Attorney, Agent, or Firm* — Keating and Bennett, LLP

(57) ABSTRACT

A fuel supply device that supplies fuel from an external tank to an engine includes a fuel injection, an internal tank, a first pipe, a second pipe, a first pump, a fuel supply quantity detection device, and a control device. The internal tank stores fuel to be delivered to the fuel injection device. The first pipe is linked to the internal tank and delivers fuel from the external tank to the internal tank. The second pipe is linked to the fuel injection device and delivers fuel from the internal tank to the fuel injection device. The fuel supply quantity detection device is attached to the first pipe and detects a quantity of fuel supplied from the external tank via the first pipe to the internal tank. The control device implements a predetermined control when the quantity of fuel detected by the fuel supply quantity detection device is below a threshold.

8 Claims, 3 Drawing Sheets

(56) References Cited

U.S. PATENT DOCUMENTS

| | | | | |
|---|---|---|---|---|
| 6,453,877 | B1 * | 9/2002 | Lucier | F02M 37/20 123/457 |
| 6,718,953 | B1 * | 4/2004 | Torgerud | F02M 37/103 123/516 |
| 7,717,086 | B2 * | 5/2010 | Akuzawa | F02B 27/0284 123/184.54 |
| 2001/0023155 | A1 * | 9/2001 | Shidara | F02B 61/045 440/1 |
| 2005/0000495 | A1 * | 1/2005 | Hamada | F02M 37/20 123/516 |
| 2005/0042947 | A1 * | 2/2005 | Saito | F02D 41/086 440/84 |
| 2006/0107925 | A1 * | 5/2006 | Bourn | F02D 31/007 123/406.44 |
| 2008/0072880 | A1 * | 3/2008 | Wachtendorf | F02D 41/2464 123/495 |
| 2009/0325432 | A1 * | 12/2009 | Kadobayashi | F02M 37/0088 440/88 F |
| 2010/0031931 | A1 * | 2/2010 | Hirose | F02M 25/0836 123/516 |
| 2010/0116361 | A1 * | 5/2010 | Furuhashi | B60K 15/077 137/398 |
| 2011/0223819 | A1 * | 9/2011 | Kazuta | B63H 21/32 440/89 B |
| 2012/0055446 | A1 * | 3/2012 | Hashizume | F02D 31/002 123/349 |
| 2014/0026862 | A1 * | 1/2014 | Nakayama | B63H 20/001 123/495 |

* cited by examiner

FUEL SUPPLY DEVICE AND OUTBOARD MOTOR

BACKGROUND OF THE INVENTION

1. Field of the Invention

The present invention relates to a fuel supply device that supplies fuel to an engine and an outboard motor.

2. Description of the Related Art

Outboard motors that include a catalyst member arranged in an exhaust pipe through which exhaust gas of the engine flows are known (see, for example, Japanese Unexamined Patent Application Publication No. 2011-190704). This kind of outboard motor includes an internal tank that temporarily stores fuel delivered from an external tank provided in the hull, and a fuel injection device that injects fuel from the internal tank into the engine.

In the case of the outboard motor disclosed in Japanese Unexamined Patent Application Publication No. 2011-190704 however, if there is insufficient fuel in the internal tank due to an insufficiency of fuel in the external tank, the air/fuel ratio inside the cylinder may become too lean causing the engine to misfire.

When this happens, uncombusted gas that leaks into the exhaust pipe from the engine may be combusted by the hot catalyst member, causing the catalyst member to overheat.

SUMMARY OF THE INVENTION

In order to overcome the problems described above, preferred embodiments of the present invention provide a fuel supply device and an outboard motor that prevent or minimize overheating of a catalyst member.

A fuel supply device according to a preferred embodiment of the present invention supplies fuel from an external tank to an engine. The fuel supply device preferably includes a fuel injection device, an internal tank, a first pipe, a second pipe, a first pump, a fuel supply quantity detection device, and a control device. The fuel injection device injects fuel into the engine. The internal tank stores fuel to be delivered to the fuel injection device. The first pipe is linked to the internal tank and delivers fuel from the external tank to the internal tank. The second pipe is linked to the fuel injection device and delivers fuel from the internal tank to the fuel injection device. The first pump pumps fuel from the internal tank via the second pipe to the fuel injection device. The fuel supply quantity detection device is attached to the first pipe and detects a quantity of fuel supplied from the external tank via the first pipe to the internal tank. The control device is programmed to perform a control operation when the quantity of fuel detected by the fuel supply quantity detection device is below a threshold.

Preferred embodiments of the present invention disclosed herein provide a fuel supply device and an outboard motor that prevent or minimize overheating of a catalyst member.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

The configuration of an outboard motor 100 according to a preferred embodiment of the present invention will now be described with reference to the drawings.

Figure 1:
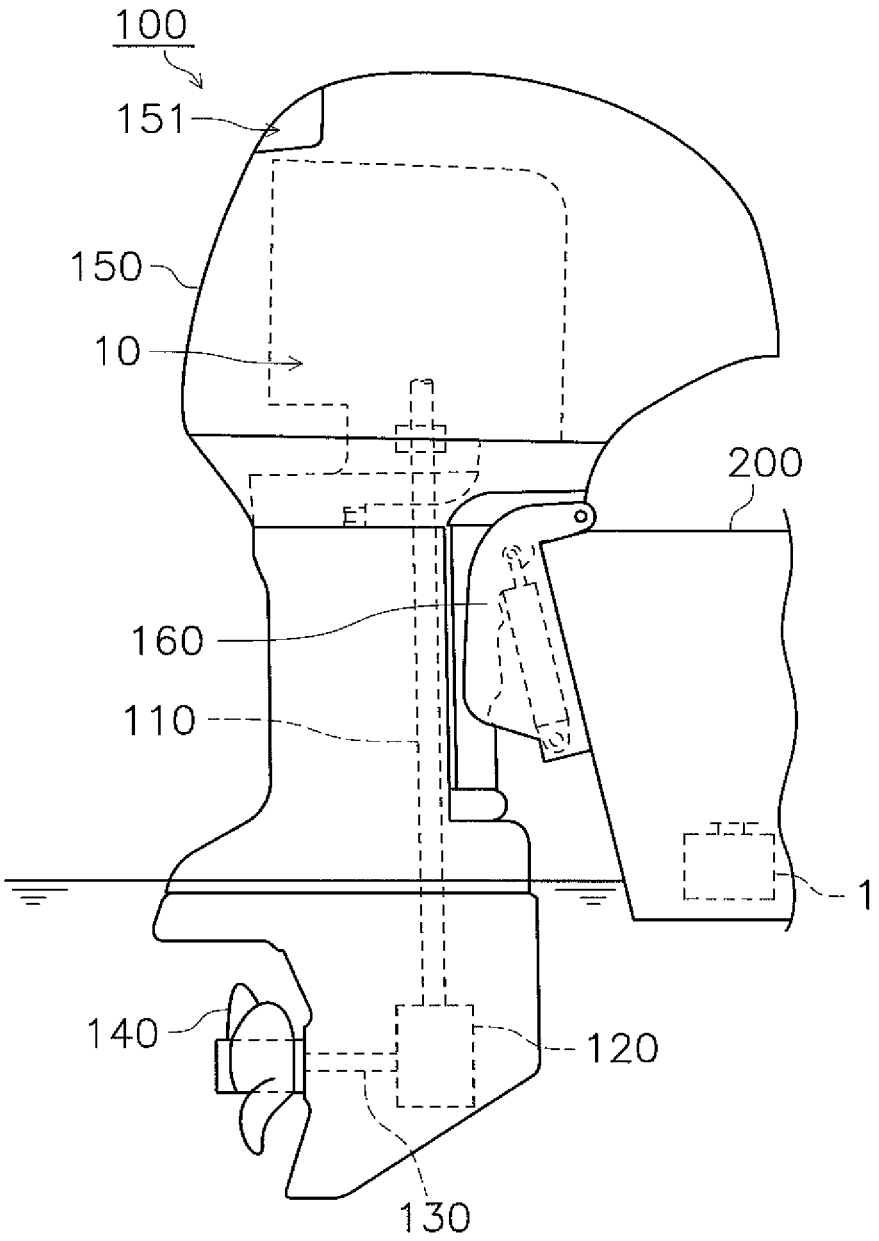
FIG. 1 is a side view of an outboard motor according to a preferred embodiment of the present invention.

FIG. 1 is a side view of the whole constitution of the outboard motor. The outboard motor 100 preferably is used as a propulsion device for a hull 200. The outboard motor 100 is attached at the rear end of the hull 200. As shown in FIG. 1, the outboard motor 100 preferably includes an engine 10, a drive shaft 110, a shift mechanism 120, a propeller shaft 130, a propeller 140, a cowling 150, and a bracket 160.

The engine 10 is an internal combustion engine that generates drive power through combustion of fuel. A fuel supply device 40 (refer FIG. 2) supplies fuel from an external tank 1 arranged in the hull 200 to the engine 10. In the present preferred embodiment, the engine 10 and the fuel supply device 40 include a fuel system 2 (refer FIG. 2). The configuration of the fuel system 2 will be described in detail below.

The drive shaft 110 is communicatively linked with the engine 10, and is rotated by a drive force from the engine 10. The shift mechanism 120 switches the rotation of the propeller shaft 130 between forward, neutral, and reverse. The propeller 140 is attached to the rear end of the propeller shaft 130.

The cowling 150 houses the engine 10. A vent 151 is provided in the cowling 150 to take in air supplied to the engine 10.

The bracket 160 communicatively links the outboard motor 100 to the hull 200. The bracket 160 supports the outboard motor 100 so as to enable the outboard motor 100 to swing from front to back and from side to side.

Figure 2:
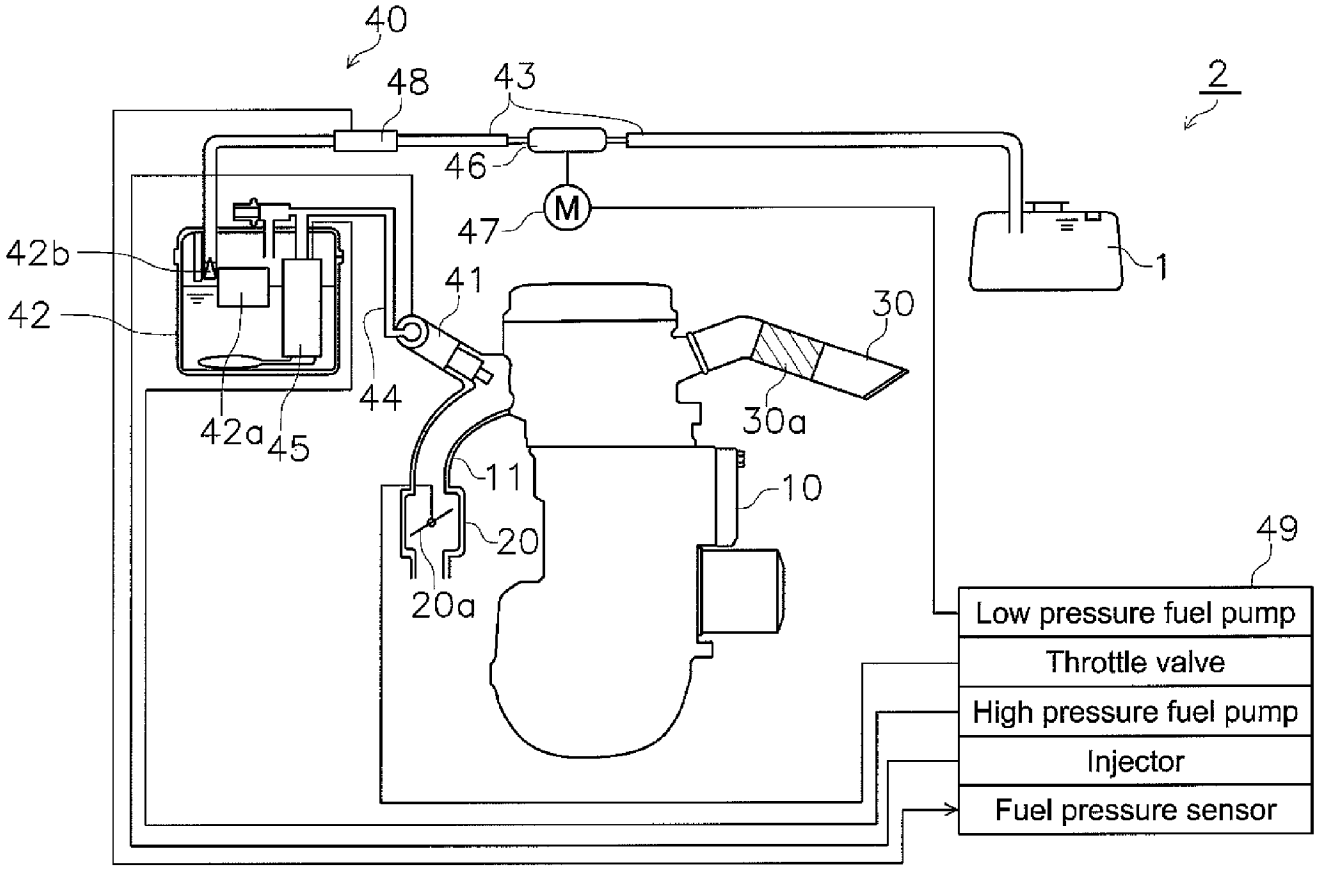
FIG. 2 is a schematic diagram showing the configuration of a fuel system according to a preferred embodiment of the present invention.

FIG. 2 is a schematic diagram showing the configuration of the fuel system 2. In FIG. 2 the external fuel tank 1 (an example of an external tank) arranged in the hull 200 is diagrammatically represented together with the fuel system 2.

As shown in FIG. 2, the fuel system 2 preferably includes the engine 10, a throttle body 20, an exhaust pipe 30, and the fuel supply device 40.

The throttle body 20 is communicatively linked with an air intake system 11 of the engine 10. The throttle body 20 includes a throttle valve **20*a* to adjust the quantity of airflow. During normal operation, an opening degree of the throttle valve 20*a*** changes in response to operation of an accelerator by the operator.

The exhaust pipe 30 discharges exhaust gas from the engine 10 into the water. A catalyst member **30*a* is preferably arranged inside the exhaust pipe 30. The catalyst member 30*a* preferably is, for example, a three-way catalyst member. A three-way catalyst member is a catalyst member in which hydrocarbons, nitrogen oxide, and carbon monoxide in the exhaust gas are simultaneously cleaned when fuel is combusted in the vicinity of the theoretical air/fuel ratio. The catalyst member 30*a* is heated to a high temperature when the engine 10 is driven. Thus, if uncombusted gas that leaks out when the engine 10 misfires reaches the catalyst member 30***a* that is heated to a high temperature, the uncombusted gas may combust in the catalyst member 30*a*. According to the present preferred embodiment, a control operation is implemented that causes a sufficient reduction in the temperature of the catalyst member 30*a* not later than when the engine 10 misfires. This control operation will be described in detail below.

The fuel supply device 40 supplies fuel from the external tank 1 to the engine 10. As shown in FIG. 2, the fuel supply device 40 preferably includes an injector 41 (an example of the fuel injection device), a vapor separator tank 42 (an example of the internal tank), a first pipe 43, a second pipe 44, a high pressure fuel pump 45 (an example of the first pump), a low pressure fuel pump 46 (an example of the second pump), an electric motor 47, a fuel pressure sensor 48 (an example of the fuel supply quantity detection device), and an ECU (engine control unit) 49.

The injector 41 is communicatively linked to the second pipe 44. Fuel is delivered from the vapor separator tank 42 to the injector 41. The injector 41 injects fuel into an air intake system 11 of the engine 10 in accordance with a predetermined timing.

The vapor separator tank 42 is communicatively linked with the first pipe 43 and the second pipe 44. The vapor separator tank 42 stores fuel that is delivered from the external fuel tank 1 via the first pipe 43. Fuel stored in the vapor separator tank 42 is delivered to the injector 41 via the second pipe 44. The vapor separator tank 42 functions to separate vaporized fuel and liquid fuel.

The vapor separator tank 42 includes a float 42*a* and a needle valve 42*b*. The float 42*a* floats on the surface of the fuel. The needle valve 42*b* is connected to the float 42*a* and the first pipe 43. When the fuel liquid surface falls below a predetermined level, the needle valve 42*b* stays open and fuel flows from the first pipe 43. When the fuel liquid surface reaches a predetermined level, the needle valve 42*b* closes and fuel stops flowing from the first pipe 43. In this manner, fuel stored in the vapor separator tank 42 is maintained at a predetermined quantity. If the external fuel tank 1 becomes empty and fuel does not flow from the first pipe 43 to the vapor separator tank 42, the needle valve 42*b* stays open.

The first pipe 43 is communicatively linked with the external fuel tank 1 and the vapor separator tank 42. The first pipe 43 delivers fuel pumped from the external fuel tank 1 to the vapor separator tank 42.

The second pipe 44 is communicatively linked with the injector 41 and the high pressure fuel pump 45. The second pipe 44 delivers fuel pumped from the vapor separator tank 42 to the injector 41.

The high pressure fuel pump 45 is arranged in the vapor separator tank 42. The high pressure fuel pump 45 is communicatively linked to the end of the second pipe 44. The high pressure fuel pump 45 pumps fuel from the vapor separator tank 42 via the second pipe 44 to the injector 41. The high pressure fuel pump 45 pumps out fuel at a predetermined pressure.

The low pressure fuel pump 46 is preferably arranged in the middle of the first pipe 43. The low pressure fuel pump 46 pumps fuel from the external fuel tank 1 via the first pipe 43 to the vapor separator tank 42. The low pressure fuel pump 46 pumps out fuel at a predetermined pressure. The low pressure fuel pump 46 is preferably driven by the electric motor 47.

The fuel pressure sensor 48 is disposed in the first pipe 43. The fuel pressure sensor 48 is preferably disposed between the vapor separator tank 42 and the low pressure fuel pump 46. The fuel pressure sensor 48 detects the quantity of fuel in the first pipe 43 that is supplied from the low pressure fuel pump 46 to the vapor separator tank 42. Specifically, the fuel pressure sensor 48 detects the pressure of fuel flowing in the first pipe 43 as the supply quantity.

The ECU 49 is electrically connected to the throttle valve 20*a*, the injector 41, the high pressure fuel pump 45, the electric motor 47, and the fuel pressure sensor 48. The ECU 49, by controlling the high pressure fuel pump 45 and the electric motor 47, is programmed to control the delivery of fuel from the external fuel tank 1 to the vapor separator tank 42 and the delivery of fuel from the vapor separator tank 42 to the injector 41.

The ECU 49 acquires the pressure of fuel detected by the fuel pressure sensor 48. The ECU 49 determines whether or not the pressure of fuel detected by the fuel pressure sensor 48 is below a minimum pressure value $P_{MIN}$ (an example of a predetermined threshold). When the fuel pressure is greater than or equal to the minimum pressure value $P_{MIN}$, the ECU 49 continues normal control. When the pressure of the fuel is less than the minimum fuel pressure value $P_{MIN}$, the ECU 49 is programmed to implement a control operation that causes a decrease in the number of rotations of the engine 10 (an example of a predetermined control, hereinafter referred to as "rpm reduction control"). Specifically, the ECU 49 is programmed to decrease the quantity of air supplied to the engine 10 by stopping the injection of fuel from the injector 41, or by closing the throttle valve 20*a*. The ECU 49 may, for example, cause a decrease in the number of rotations of the engine 10 to the number of rotations $R_{IDL}$ at a time of idling.

Figure 3:
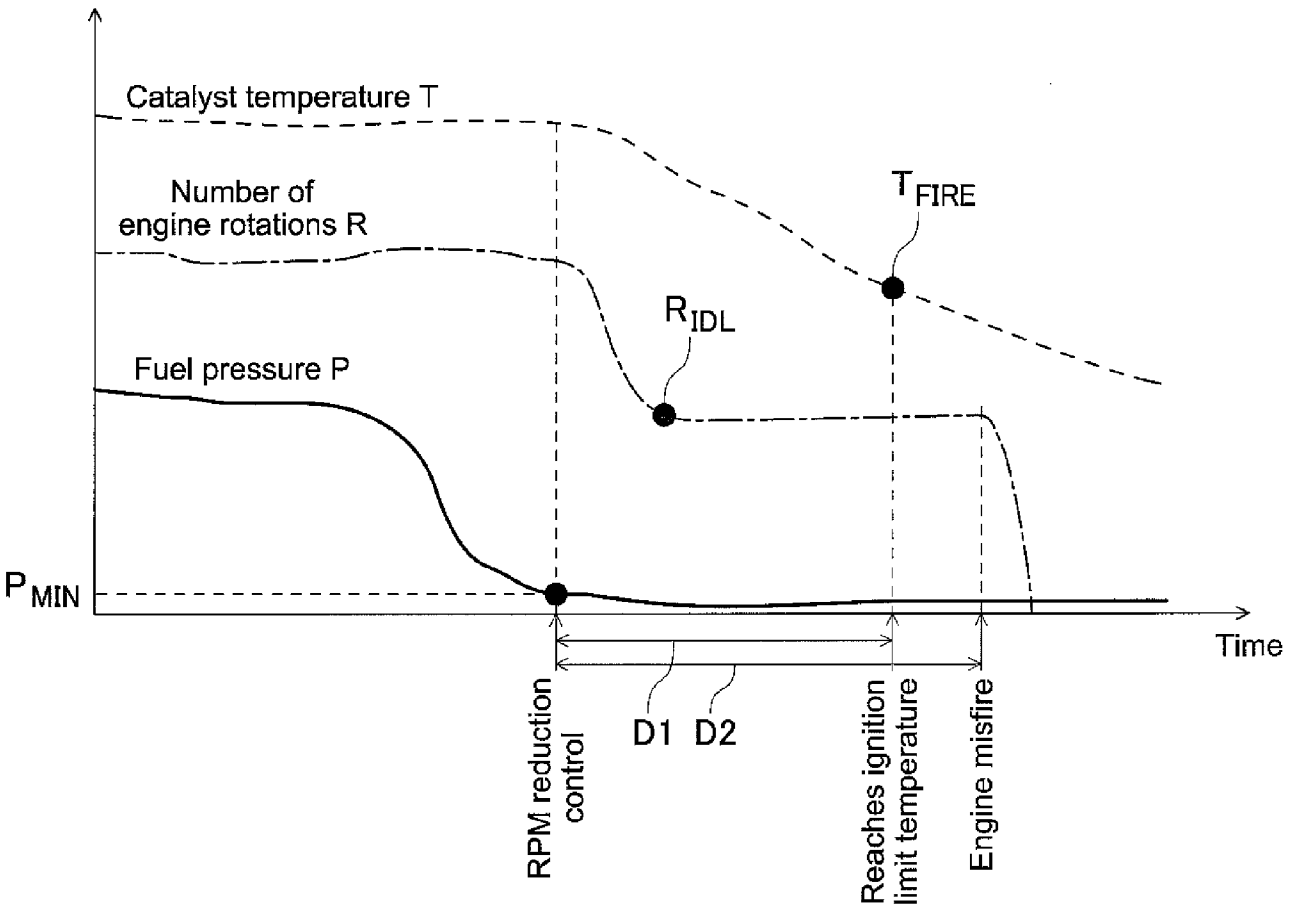
FIG. 3 is a time series graph showing fuel pressure, number of rotations of the engine, and the temperature of the catalyst member.

The method of determining the minimum pressure value $P_{MIN}$ will now be described with reference to FIG. 3. FIG. 3 is a time series graph showing the fuel pressure P detected by the fuel pressure sensor 48, the number of rotations R of the engine 10, and the temperature T of the catalyst member 30*a*.

In FIG. 3, an ignition limit temperature $T_{FIRE}$ is the temperature of the catalyst member 30*a* at which uncombusted gas does not ignite. A required time D1 is the time from commencement of the rpm reduction control until the temperature of the catalyst member 30*a* is reduced to the ignition limit temperature $T_{FIRE}$. A delay time D2 is the time from commencement of the rpm reduction control until the engine 10 misfires. FIG. 3 illustrates the example in which the ECU 49, during the rpm reduction control, controls the engine 10 to idle at the rpm $R_{IDL}$.

As shown in FIG. 3, it is preferable that the minimum pressure value $P_{MIN}$ be set such that the required time D1 is longer than the delay time D2. By setting the required time D1 to be longer than delay time D2, even if uncombusted gas leaks into the exhaust pipe due to misfiring of the engine 10, combustion of the uncombusted gas by the catalyst member 30*a* is prevented.

As described above, the fuel supply device 40 of the present preferred embodiment detects that the vapor separator tank 42 is empty and, by lowering the temperature of the catalyst member 30*a* in advance, is able to prevent an excessive temperature in the catalyst member 30*a* due to ignition of uncombusted gas.

Although preferred embodiments of the present invention have been described above, it is understood that the present invention is not limited by the description and the drawings described above. It will be clear to those skilled in the art that various modifications, working examples, and techniques may be practiced in light of the above teachings.

In the above-described preferred embodiments, the fuel supply device 40 preferably includes the fuel pressure sensor 48 as an example of a fuel supply quantity detection device. This configuration should be interpreted as illustrative and not restrictive however. It is also suitable for the fuel supply device 40 to include a fuel flow quantity sensor that detects the quantity of fuel flowing in the first pipe 43 as an example of a fuel supply quantity detection device. In this case, it is suitable for the ECU 49 to reduce the number of rotations of the engine 10 when the flow quantity of fuel detected by the fuel flow quantity sensor is less than a minimum flow value (an example of a predetermined threshold). It is preferable for the minimum flow quantity value to be set with reference to the required time D1 and the delay time D2 (refer FIG. 3) in the same manner as the above described minimum pressure value $P_{MIN}$.

Further, it is preferable that the fuel flow quantity sensor as an example of the fuel supply quantity detection device be arranged between the vapor separator tank 42 and the low pressure fuel pump 46. In order to detect the quantity of flow of the pressurized fuel, this configuration enables a more accurate measurement of the flow quantity in comparison to the case in which the sensor is arranged between the external fuel tank 1 and the low pressure fuel pump 46.

In the above described preferred embodiments, the ECU 49, during rpm reduction control, causes the number of rotations of the engine 10 to decrease to the idling rpm $R_{IDL}$. This configuration should be interpreted as illustrative and not restrictive however. It is also suitable for the number of rotations of the engine 10 in rpm reduction control to be set at a desired value, such that the ECU 49 may reduce the rotations of the engine 10 to "0" (in other words, stopped).

In the above-described preferred embodiments, the ECU 49, during rpm reduction control, either stops the injector 41 or alters the opening degree of the throttle valve 20*a*. However, it is also suitable to use both methods.

In the above-described preferred embodiments, the ECU 49 implements the rpm reduction control as an example of a predetermined control. However, this configuration should be interpreted as illustrative and not restrictive, and it is also suitable for the ECU 49 to generate an alarm as a predetermined control. The alarm can be, for example, an announcement of an alert or a display of a warning.

In the above-described preferred embodiments, the high pressure fuel pump 45 is arranged inside the vapor separator tank 42. This configuration should be interpreted as illustrative and not restrictive however. It is also suitable for the high pressure fuel pump 45 to be arranged outside the vapor separator tank 42. Again, although in the above-described preferred embodiments the high pressure fuel pump 45 preferably is communicatively linked to an end of the second pipe 44, it is also suitable for the high pressure fuel pump 45 to be attached in the middle of the second pipe 44.

In the above described preferred embodiments, the low pressure fuel pump 46 preferably is electronically driven by the electric motor 47. However, this configuration should be interpreted as illustrative and not restrictive, and it is also suitable for the low pressure fuel pump 46 to be mechanically driven by the rotations of the crankshaft of the engine 10.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A fuel supply device that supplies fuel from an external tank to an engine, the fuel supply device comprising:

a fuel injection device configured to inject fuel into the engine;

an internal tank configured to store fuel to be delivered to the fuel injection device;

a first pipe linked to the internal tank, the first pipe configured to deliver fuel from the external tank to the internal tank;

a second pipe linked to the fuel injection device, the second pipe configured to deliver fuel from the internal tank to the fuel injection device;

a first pump configured to pump fuel from the internal tank via the second pipe to the fuel injection device;

a fuel supply quantity detection device attached to the first pipe upstream of the internal tank, the fuel supply quantity detection device configured to detect a quantity of fuel supplied from the external tank via the first pipe to the internal tank; and a control device configured and programmed to implement at least one of a control operation that causes a decrease in a number of rotations of the engine, a control operation that outputs an alert, and a control operation that displays a warning when the quantity of fuel detected by the fuel supply quantity detection device is below a threshold.

2. The fuel supply device according to claim 1, further comprising:

a second pump attached to the first pipe, the second pump configured to pump fuel from the external tank via the first pipe to the internal tank; wherein the fuel supply quantity detection device is located between the internal tank and the second pump; and the fuel supply quantity detection device detects a pressure of fuel flowing in the first pipe from the second pump to the internal tank as the quantity of fuel.

3. The fuel supply device according to claim 1, wherein the fuel supply quantity detection device is configured to detect a quantity of fuel that flows in the first pipe to the internal tank as the quantity of fuel.

4. The fuel supply device according to claim 3, further comprising:

a second pump configured to pump fuel via the first pipe to the internal tank; wherein the fuel supply quantity detection device is located between the internal tank and the second pump.

5. The fuel supply device according to claim 1, wherein the control device is configured and programmed to cause the decrease in the number of rotations of the engine during the at least one of the control operation.

6. The fuel supply device according to claim 5, wherein the control device is configured and programmed to cause the decrease in the number of rotations of the engine by stopping an injection of fuel from the fuel injection device.

7. The fuel supply device according to claim 5, wherein the control device is configured and programmed to cause the decrease in the number of rotations of the engine by reducing a quantity of air supplied to the engine.

8. An outboard motor comprising:

an engine;

an exhaust pipe linked with the engine, the exhaust pipe configured to deliver exhaust gas from the engine;

a catalyst member arranged in the exhaust pipe, the catalyst member configured to clean the exhaust gas; and the fuel supply device according to claim 1.

* * * * *